US007917973B2

(12) United States Patent
Baumoel

(10) Patent No.: US 7,917,973 B2
(45) Date of Patent: Apr. 5, 2011

(54) HANDS FREE SYSTEM FOR LIFTING AND LOWERING A TOILET SEAT

(76) Inventor: Joseph Baumoel, Wellington, FL (US)

( * ) Notice: Subject to any disclaimer, the term of this patent is extended or adjusted under 35 U.S.C. 154(b) by 0 days.

(21) Appl. No.: 12/557,071

(22) Filed: Sep. 10, 2009

(65) Prior Publication Data

US 2011/0056005 A1 Mar. 10, 2011

(51) Int. Cl.
*A47K 13/10* (2006.01)

(52) U.S. Cl. ..... 4/246.1

(58) Field of Classification Search ..... 4/246.1–246.5, 4/667

See application file for complete search history.

(56) References Cited

U.S. PATENT DOCUMENTS 5,603,127 A * 2/1997 Veal ..... 4/246.1
6,226,804 B1 5/2001 Ballard
6,230,336 B1 5/2001 Knoll et al.
6,321,393 B1 * 11/2001 Jones ..... 4/246.1
6,643,852 B1 * 11/2003 Lin ..... 4/246.1
7,039,961 B1 5/2006 Kirk
7,380,292 B1 6/2008 Harris
7,636,956 B1 * 12/2009 Doucet ..... 4/246.1
2005/0217010 A1 10/2005 Hayashi et al.
2006/0242755 A1 * 11/2006 Lohss ..... 4/246.1
2007/0056084 A1 * 3/2007 Watt et al. ..... 4/246.1
2007/0056085 A1 3/2007 Dyson et al.
2007/0057215 A1 3/2007 Parsons et al.
2008/0256445 A1 10/2008 Olch et al.

OTHER PUBLICATIONS

International Search Report dated Nov. 2, 2010 corresponding to International Application No. PCT/US2010/048382.

* cited by examiner

*Primary Examiner* — Huyen Le
(74) *Attorney, Agent, or Firm* — F. Chau & Associates, LLC

(57) ABSTRACT

An apparatus configured to lift and lower a seat assembly of a toilet includes a case that is configured to be mounted to the toilet using mounting bolts of the seat assembly. The case includes a passive infrared sensor (PIR) that outputs a detection signal in response to motion, a motor having a lever coupled to the shaft of the motor via a coupler, a direction control unit that applies a motor supply voltage to drive the shaft of the motor in one of a clockwise or counterclockwise direction in response to the detection signal, and a battery to provide power to the apparatus.

17 Claims, 10 Drawing Sheets

HANDS FREE SYSTEM FOR LIFTING AND LOWERING A TOILET SEAT

BACKGROUND OF THE INVENTION

1. Technical Field

The present disclosure relates to a hands free system for lifting and lowering a toilet seat, and more particularly to a hands free system for lifting and lowering a toilet seat that can adapt to user interference.

2. Discussion of Related Art

Public restrooms may be used by thousands of people daily and bacteria flourishes easily in these damp, moist environments. Restrooms are prime sources of contamination simply because of their function. Because bodily fluids can transmit disease, toilets are obvious contamination points.

For example, a user typically needs to make contact with the flushing handle of the toilet. Toilets presently exist that automatically flush themselves once a user is finished, enabling the user to avoid contact with the handle.

However, individuals may also be exposed to contaminants when they lift or lower the seat of the toilet. Thus, there is a need for a hands free system that can lift and lower a toilet seat, without the need for the user to make physical contact with the toilet.

Such a hands free system may interact with unpredictable users, who could accidentally or intentionally interfere with the performance of the system. Thus, there is a further need for a hands free system that can operate safely in the presence of user interference.

SUMMARY OF THE INVENTION

According to an exemplary embodiment of the present invention, an apparatus configured to lift and lower a seat assembly of a toilet includes a case that is configured to be mounted to the toilet using mounting bolts of the seat assembly. The case includes a passive infrared sensor (PIR) that outputs a detection signal in response to motion, a motor having a lever coupled to the shaft of the motor via a coupler, a direction control unit that applies a motor supply voltage to drive the shaft in one of a clockwise or counterclockwise direction in response to the detection signal, and a battery to provide power to the apparatus.

According to an exemplary embodiment of the present invention, an apparatus configured to lift and lower a toilet seat includes a case that is configured to be mounted to a toilet using mounting bolts of a seat assembly of the toilet. The case includes a first passive infrared sensor (PIR) that outputs a first detection signal in response to motion, a second PIR that outputs a second detection signal in response to motion, a motor having a lever coupled to the shaft of the motor via a coupler, and a direction control unit that applies a motor supply voltage to drive the shaft of the motor in one of a clockwise or counterclockwise direction in response to both of the detection signals. The detection control unit triggers the shaft to rotate in one of the clockwise or counterclockwise direction upon detecting that the first and second detection signals have occurred in succession within a first period and triggers the shaft to rotate in the other direction upon determining that the second and first detection signals have occurred in succession within a second period.

According to an exemplary embodiment of the present invention, an apparatus configured to lift and lower a seat assembly of a toilet includes a case that is configured to be mounted to the toilet using mounting bolts of the seat assembly. The case includes a passive infrared sensor (PIR) that outputs a detection signal in response to motion, a motor, a battery to provide power to the apparatus, a gear train, a lifting mechanism, and a controller. The gear train includes a motor pinion gear, a spur gear including a first hub, the first hub having a bearing, a second hub including a second bearing, and a connecting rod. The motor pinion gear is attached to the shaft of the motor, the motor pinion gear is engaged with the spur gear, the spur gear is engaged with the second hub, and a first end of the connecting rod connects to the first bearing and a second opposite end of the rod connects to the second bearing. The lifting mechanism includes a lever, the lever driven by a shaft attached to the second hub that exits the case. The controller is configured to apply a motor supply voltage to drive the shaft of the motor in one of a clockwise or counterclockwise direction in response to the detection signal.

According to an exemplary embodiment of the present invention, an apparatus configured to lift and lower a seat assembly of a toilet includes a case that is configured to be mounted to the toilet using mounting bolts of the seat assembly. The case includes a passive infrared sensor (PIR) that outputs a detection signal in response to motion, a motor, a battery to provide power to the apparatus, a gear train, a lifting mechanism, and a controller. The gear train includes a motor pinion gear, a spur gear including a first hub, a second hub, a wire rope, and a clutch. The motor pinion gear is attached to the shaft of the motor. The motor pinion gear is engaged with the spur gear. The wire rope is wrapped around the first and second hubs. The lifting mechanism includes a lever driven by a shaft coupled to the second hub that exits the case. The controller is configured to apply a motor supply voltage to drive the shaft of the motor in one of a clockwise or counterclockwise direction in response to the detection signal.

BRIEF DESCRIPTION OF THE DRAWINGS

Exemplary embodiments of the invention can be understood in more detail from the following descriptions taken in conjunction with the accompanying drawings in which.

DETAILED DESCRIPTION OF THE EXEMPLARY EMBODIMENTS

Exemplary embodiments of the present invention will be described below in more detail with reference to the accompanying drawings. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
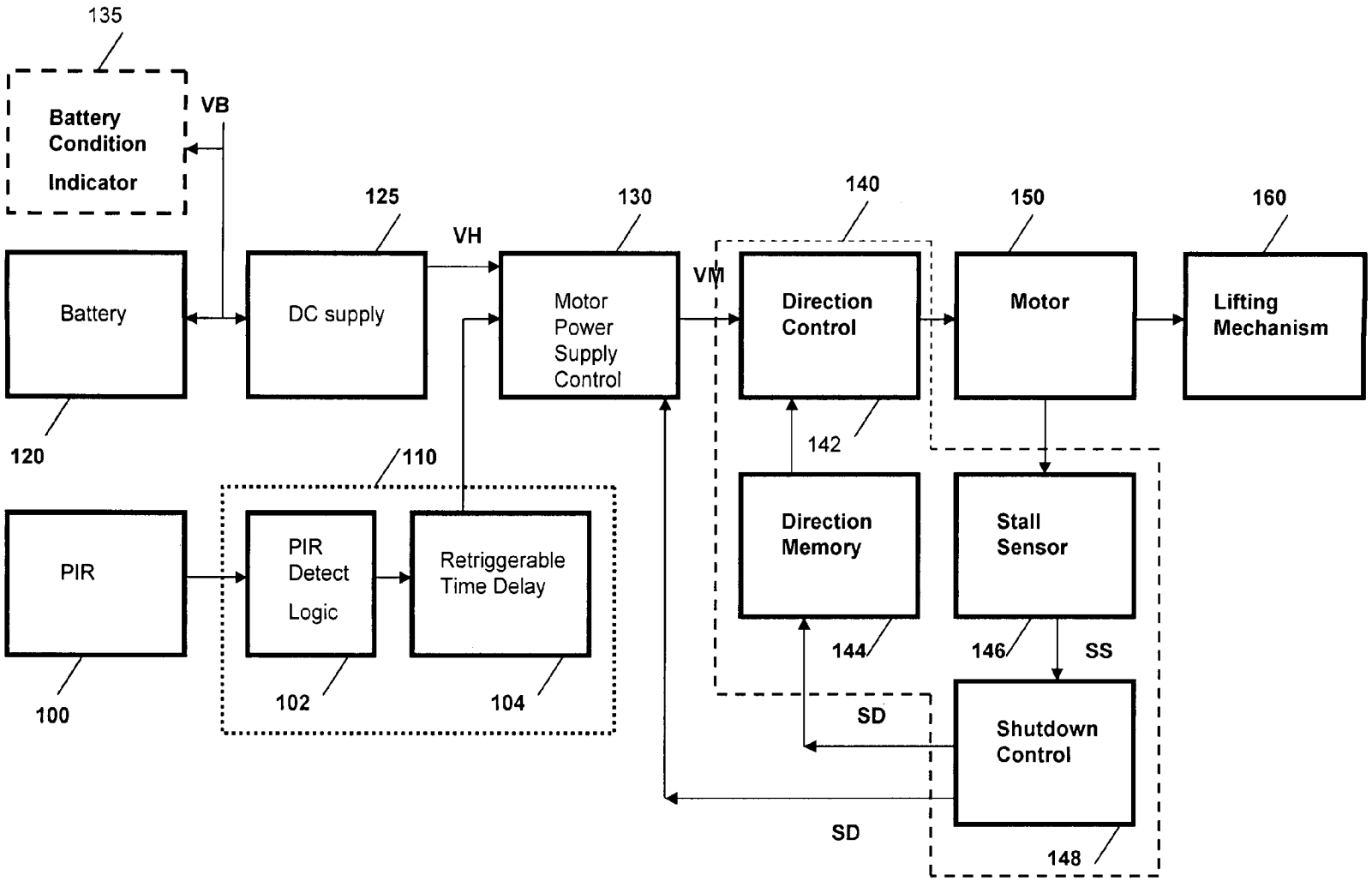
FIG. 1 illustrates a high-level block diagram of an apparatus to lift and lower a toilet seat in a hands free manner, according to an exemplary embodiment of the present invention.

FIG. 1 illustrates a high-level block diagram of an apparatus to lift and lower a toilet seat (and/or its lid) in a hands free manner, according to an exemplary embodiment of the present invention. The apparatus includes a Passive Infrared Sensor (PIR) 100, a Detection Controller Unit 110, a Motor Power Supply Unit 130, a Direction Controller Unit 140, a Motor 150, and a Battery 120.

The Detection Controller Unit 110 may include a PIR Detection Logic Module 102 and Re-Triggerable Time Delay Module 104. The Direction Controller Unit 140 may include a Direction Control Module 142, a Direction Memory Module 144, a Stall Sensor Module 146, and a Shutdown Control Module 148.

The apparatus is housed within a case. The case may be configured to fit between the bolts, the seat, and water tank of the toilet. In an embodiment of the present invention, the shaft of the Motor 150 exits the case and a lever of the lifting mechanism 160 is attached to the shaft via a coupler. The coupler may include a spring clutch. This embodiment will be discussed later in more detail with respect to FIGS. 3-5. In alternate embodiment of the present invention, instead of the lever being connected to the shaft of the Motor 150, a gear train is attached to increase torque of the Motor 150, and the lever of the lifting mechanism 160 is attached to a shaft of the gear train (e.g., via a coupler). This embodiment will be discussed later in more detail with respect to FIGS. 6-8.

Referring to FIG. 1, the apparatus may include a DC Power Supply 125 (e.g., about 12 v to about 16 v) and a Battery Condition Indicator 135. The Battery 120 supplies power to the DC Power Supply 125. The DC Power Supply 125 maintains a supply voltage $V_H$ to power the Motor Power Supply Unit 130. The Battery 120 may be rechargeable from a remote power source or may be non-rechargeable. The Battery Condition Indicator 135 is optional, and may cause an externally visible alarm light (e.g., an LED) to blink when a low charge is detected, or an internal buzzer to sound.

The case may be secured to a toilet such that a portion of the lever is positioned below a portion of the toilet seat assembly, at or near the axis of rotation of the assembly. Alternately, the case may be secured such that the lever is positioned under the toilet seat assembly to provide a new axis of rotation. The lever lifts or lowers the toilet seat and/or lid when the apparatus is activated by motion of a user (e.g., by motion of a hand near the PIR 100 of the apparatus).

The PIR 100 may be a pyro-electric device (e.g., sensor) that detects the motion by measuring changes in the infrared levels emitted by surrounding objects. The PIR 100 may have a predefined or configurable motion detection distance range (e.g., 0.5 meters) and detection angle (e.g., about 10 degrees to about 60 degrees). In an exemplary embodiment of the present invention, the detection distance is set to a defined area around the toilet. Alternately, ultrasonic or radio frequency means of detection may be used instead of infrared.

The PIR 100 may be disposed under an infrared filter window in a top cover of the case. The PIR 100 causes a change in its output voltage (e.g., a PIR signal) when it detects the arrival of infrared light, as when a hand is placed above the window. This output voltage may be sent to the PIR Detection Logic Unit 102, which analyzes the PIR signal to determine whether it meets certain criteria. For example, the criteria may specify a magnitude and length of a duration that would be associated with the presence and movement of a hand in the detection region above the window.

In the event that the PIR signal meets the criteria, the Re-Triggerable Time Delay Unit 104 (e.g., a re-triggerable OneShot) may be triggered to an 'on' state, and emit a control signal (e.g., a pulse with a positive leading edge) to turn on the Motor Power Supply Unit 130. The control signal may be set such that its minimum length assures that no other power-on command is issued during the 'on' time duration of the OneShot. However, if another acceptable PIR signal is detected during the normal 'on' time period of the OneShot, the time may be extended by a predetermined nominal 'on' time period of the OneShot. At the end of the period of time after the last trigger or re-trigger of the OneShot, the OneShot reverts to an 'off' state.

On receipt of the control signal (e.g., on receipt of the leading edge of the 'on' period of the OneShot), the Motor Power Supply Unit 130 is turned on. The Motor Power Supply Unit 130 supplies a voltage Vm to the Motor 150 via the Direction Control Module 142, which applies the voltage Vm to the motor coil of the Motor 150 to spin the shaft of the motor 150 in the clockwise rotation direction, or by reversing the side of the coil receiving voltage Vm, to spin the shaft in the counter-clockwise direction. The direction of rotation may be controlled by a Direction Memory Module 144 of the Direction Controller Unit 140, which commands either clockwise or counterclockwise rotation, which is reversed after completion of the last complete cycle of seat movement.

Since the lever is attached directly or indirectly to the shaft, and the lever is positioned under the seat assembly (e.g., the toilet seat), when the Motor Power Supply Unit 130 is turned on, rotation of the Motor 150 cause the seat to either lift or lower based on the direction that the shaft is rotated. The Direction Memory Module 144 stores the direction that the shaft is to be rotated to reverse the prior action and may store a default rotation direction initially. The Direction Control Module 142 uses this stored value to determine the direction that the shaft is to be rotated. Each subsequent triggering of the apparatus lifts or lowers the toilet seat in the opposite direction as it last traveled.

The lever is not permanently attached to the bottom of the toilet seat. As the lever lifts the seat, if the axes of rotation of the seat and lever are not properly aligned, the lever may slide along the bottom surface of the seat. A material that has a low coefficient of friction (e.g., Teflon) may be attached to the top surface of the lever to facilitate this sliding. When the lever is angled just short of a vertical position, due to gravity, the lever should remain in contact with the seat. However, if the lever extends beyond the vertical position, the seat may fall away from contact with the lever (e.g., the seat may fall away to contact the toilet tank). This can be prevented by creating a point of resistance for the lever. For example, a fixed or adjustable interference can be attached to the case in the path of the lever to obstruct the path of the lever before it reaches a vertical position.

Based on the design of the toilet, when lifting the seat, the seat could contact the toilet tank before moving beyond a vertical position, and thus the added interference may not be necessary. When the toilet seat is lowered, the seat or lever will eventually make contact with the toilet bowl. Further, the lever may experience a contact when a user uses his hands or foot to stop the seat while it is being lifted or lowered or pushes the seat in a direction opposite to which it is being currently moved by the Motor 150.

However, after one of the above described contacts has been made, the Motor 150 may attempt to continue spinning its shaft, which may strip the gears of the Motor 150. Thus, the Motor 150 may be turned off when or soon after these points of resistance are reached. Once the seat has reached either the 'up' or 'down' position, or encounters an artificial point of resistance, the physical interference with continued rotation will cause the current of the Motor 150 to increase towards its highest level, which may be referred to as Stall current.

The Stall Sensor Module 146 can continuously monitor the current of the Motor 150. When the level of the current exceeds a predefined normal operating current level (NOCL) or the NOCL plus a predefined current offset CO, the Stall Sensor Module 146 may output a stall signal SS to trigger the Shutdown Control Module 148 to send a shutdown SD signal to power down the Motor 150. In one embodiment, the NOCL plus the CO is set below the level of the Stall current.

The Shutdown Control Module 148 may send the shutdown signal SD immediately to the Direction Control Module 142 and the Motor Power Supply Unit 130 in response to the stall signal SS. The Direction Control Module 142 toggles the up/down state of the stored rotation direction in response to the shutdown signal SD. The Motor Power Supply 130 is powered down in response to the shutdown signal. For example, assume that the seat moving down and encountering the natural resistance of the toilet bowl triggered the shutdown. The Direction Memory Module 144 would then have stored a rotation direction of 'up' in response to the shutdown signal (e.g., The Direction Control Module 142 toggles 'down' to 'up'). When the PIR 100 is re-triggered due to motion, a new control signal would be generated by the Detection Controller Unit 110 to turn on the Motor Power Supply Unit 130, enabling the Motor Power Supply Unit 130 to again deliver the voltage Vm to the Direction Controller Unit 140. The Direction Control Module 140 would then apply the voltage Vm to the Motor 150 to spin its shaft according to the stored rotation direction (e.g., up), thereby causing the seat to lift upwards.

Alternately, the Shutdown Control Module 148 may be configured to output different shutdown signals of different time delays to the Direction Control Module 142 and the Motor Power Supply Unit 130 (e.g., a first shutdown signal and a second shutdown signal). For example, the Stall Sensor Module 146 may trigger a shutdown control operation of the Shutdown Control Module 148 by emitting a positive edge. The leading edge of the pulse may cause the Shutdown Control Module 148 to output the first shutdown signal to the Direction Control Module 142 having a first duration. At the expiration of the first duration, the Direction Control Module 142 toggles the state of the stored rotation direction. The leading edge of the pulse may cause the Shutdown Control Module 148 to delay for a predetermined period and upon expiration of the delay, output the second shutdown signal (e.g., a negative pulse) to the Motor Power Supply Unit 130, causing it to shutdown. In this way, the Direction Control Module 142 is able to toggle the storage state of the direction of rotation before the Motor Power Supply Unit 130 is powered down. If the Motor Power Supply Unit 130 is powered down without this delay, the Direction Memory Module 144 may not have enough time to update the state of the rotation direction. The shutdown operation includes the detection of the stall and the removal of power to the Motor 150. The shutdown operation is configured such that power is removed from the Motor 150 before the continued operation of the Motor 150 has enough time to damage its gears.

Each time the seat moves either from the 'down' position to the 'up' position or the 'up' position to the 'down' position is considered one complete cycle of the apparatus. At completion of one of these cycles, the apparatus is in an initial state of waiting for a PIR signal to start the next cycle of seat movement. At this time, the voltage Vm may be removed from the Motor Power Supply Unit 130 (e.g., Vm no longer supplied to Unit 130), thereby reducing the drain on the Battery 120. However, the DC Power Supply 125 can remain active to assure continued operation of the PIR 100. Battery power may be saved further by using a sleep mode to power down the circuits that remain active. For example, the DC Power Supply 125 could be disengaged from the battery 120 using a switch during the sleep mode and then re-engaged during a waking mode. For example, a third of every 100 ms of operation could correspond to the sleep mode and the other two thirds could correspond to the wake mode. This is merely an example, as the duty cycle of the apparatus may be changed as desired.

Figure 2:
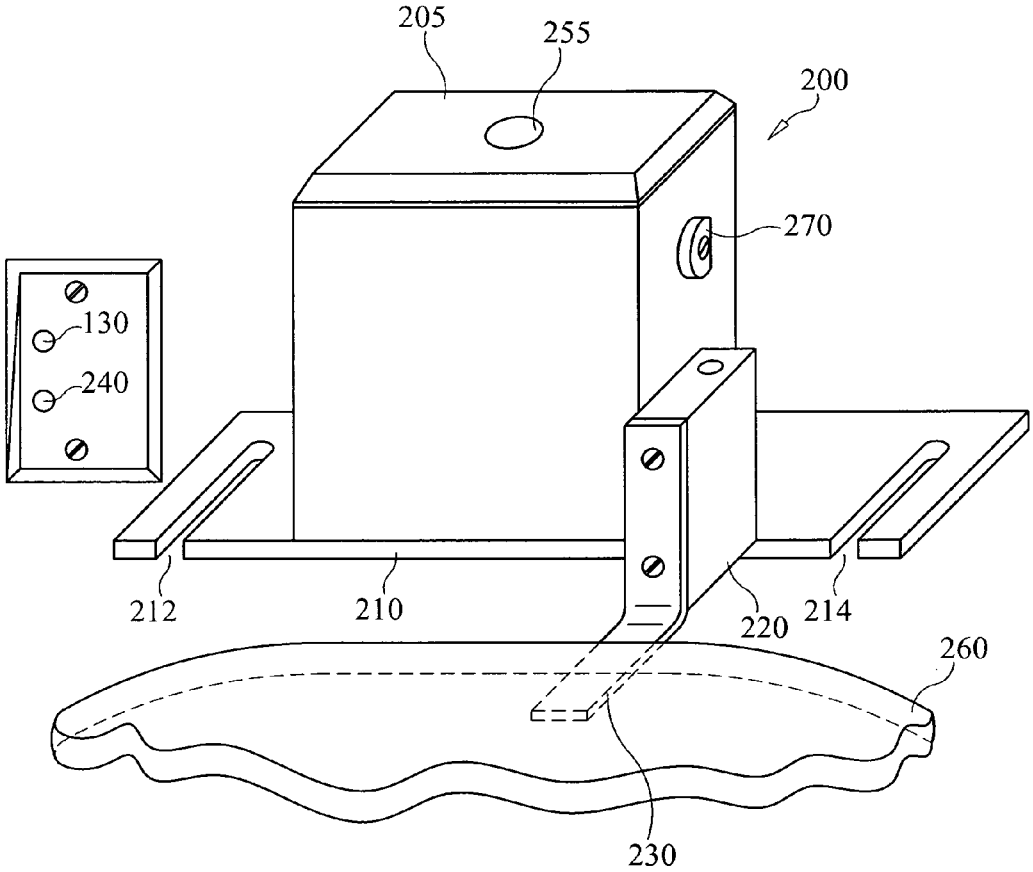
FIG. 2 illustrates an assembly view of the apparatus of FIG. 1, according to an exemplary embodiment of the present invention.

FIG. 2 illustrates an assembly view of the apparatus of FIG. 1, according to an exemplary embodiment of the present invention. The Case 200 of the apparatus includes a Base 210 and a Coupler 220 that attaches the Lever 230 to the shaft of the Motor 150. As discussed above, and shown in FIG. 2, the apparatus is positioned such that the Lever 230 is positioned below a Toilet Seat 260. The Lever 230 is coupled to the shaft (not shown) of the Motor 140 via the Coupler 220. In this example, the shaft exits the side of the case. However, in an alternate embodiment, the Lever 230 may be coupled to a shaft (not shown) or portion of a gear train that exits the front of the case.

A filter window 255 is located in a wall (e.g., the Cover 205) of the Case 200. The filter window 255 may be alternately located in one of the side walls or the front wall of the Case 200.

The Battery Condition Indicator 135 may be located in a wall (e.g., a side wall) of the Case 200. The Battery Indicator 130 may be alternately located in the front wall or omitted. The Case 200 may include a Recharge Port 240 in a side wall for recharging the Battery 120. Alternately, the Recharge Port 240 may be located in the Cover 205, the front wall, or the rear wall. The Recharge Port 240 may be omitted (e.g., when a non-rechargeable battery is used). Alternately, an internal audible buzzer may be included within the Case 200 that sounds to indicate the need to recharge or replace the Battery 120.

An adjustable interference 270 may be attached on the same side of the Case 200 as the Coupler 220. The interference 270 is positioned such that it rests in the path of the Coupler 220 or the Lever 230 to interfere with the rotation of the Coupler 220 or the Lever 230. If the interference is positioned properly, as the Coupler 220 rotates, it will eventually contact the interference 270, and the Motor 150 turns off shortly thereafter. The interference 270 may have an asymmetric shape and be rotated to adjust the upper limit for the Lever 230. Alternately, a fixed interference may be used to fix the upper limit of the Lever 230.

The Case 200 may be attached to the Base 210 in various ways, such as welding, nails, screws, glue, solder, etc. The Base 210 may be configured to lie on the plane of the toilet. A seat assembly of the toilet (e.g., the Toilet Seat 260 and a Toilet Seat Lid) is typically mounted to a toilet bowl by means of two mounting bolts. The Base 210 is configured to mount under the seat assembly mounts and lie on the surface (e.g., ceramic) of the toilet bowl. The Base 210 is held in place by the same mounting bolts that are used to connect the seat assembly to the toilet bowl. For example, the Base 210 may include a left slot 212 and a right slot 214 that are spaced to correspond to spacing of the seat mounting bolts and dimensioned to receive the bolts. The slots 212 and 214 provide for installation of the apparatus without the need to fully remove the seat and lid mounts, and also for adjusting a relative distance between the front of the Base 210 and the rear of the Toilet Seat 260. In an alternate embodiment of the present invention, the slots 212 and 214 are replaced with corresponding holes (e.g., circular, oblong, etc.) to receive the mounting bolts. The slots 212 and 214 permit the Lever 230 to be moved nearer to or further from the Seat 260, permitting the rotation axis of the Lever 230 to conform more closely to the axis of rotation of the Seat 260.

As discussed above, the Motor 150 is internal to the Case 200 and either the shaft or a portion of a gear train (e.g., a rod) exits from a side or front of the Case 200. The Coupler 220 is installed on the shaft or rod. For example, the shaft may have a flat, which is engaged within the Coupler 220 by a spring and washer, which is forced by the spring onto the flat. The force of the spring may be controlled by advancing a bolt, entering the Coupler 220 from the top, and constraining the coupler to rotate as the shaft rotates. This spring assembly forms a clutch which permits the washer to be forced off the flat, if excessive force is applied by manual lifting or lowering of the seat 260, which force is transmitted to the coupler 220 via the Lever 230. This prevents such movement of the Seat 260 from applying external force to the gears of the Motor 150, which could cause damage to those gears. Thus the shaft is decoupled from the Coupler 220, and will be re-coupled when rotation of the shaft once again brings the washer in line with the flat, which permits the spring to force the washer up against the flat once more.

If, when the motor is not running under power, and the shaft is not decoupled from the Coupler 220, application of an excessive force to the shaft could damage the Motor 150 or its gears. When the motor is not running, the Stall Sensor Module 146 cannot sense when this excessive force is occurring by detecting an impending Stall Current and triggering the powering down of the Motor 150. Accordingly, when such force occurs, the clutch protects the Motor 150 by decoupling the Lever 230 and Coupler 220 from the Motor 150 or its Gear Train.

If the Seat 260 ever becomes hung in mid position after power to the Motor 150 is turned off, upon retriggering the PIR 100, the Seat 260 will either go up or down based the current state of the saved rotation direction (e.g., which may be stored in direction memory 144).

The Coupler 220 drives the Lever 230, which is positioned so that, with the Toilet Seat 260 down, the Lever 230 contacts the bottom side of the Seat 260. Then, when the Coupler 220 rotates in, for example, the clockwise direction, the Lever 230 exerts a lifting force on the bottom of the Seat 260, causing it to lift. When the Seat 260 is up, an alternate rotation of the shaft (e.g., in a counter-clockwise direction) causes the Lever 230 to disengage from the bottom side of the Seat 260.

If the position of the Seat 260 is less than vertical, gravity causes the Seat 260 to fall against the Lever 230 and follow it down. If the Seat 260 has been lifted past vertical (e.g., assume the interference 270 is not present or is improperly positioned), in an alternate embodiment of the present invention, a second part of the Lever 230 can be attached to the Coupler 220 to contact the top surface of the Seat 260, to exert a force to lower the Seat 260 when the shaft is rotated to lower the Seat 260 (e.g., in a counter-clockwise direction). Alternately, the Lever 230 can provide a flexible lanyard (e.g., a rope), attached to the bottom of the Seat 260 by tape or some other temporary attachment mechanism. When the shaft rotates in the 'down' direction, the lanyard can pull the Seat 260 to just below vertical, and then the Seat 260 will continue to follow the Lever 230 downward with the force of gravity.

In an alternate embodiment of the present invention, sensors may be attached to the Case 200 to detect the position of the Coupler 220. For example, the sensors would detect whether the Coupler 220 is about exceed vertical and could trigger a mechanism to restrain the Coupler 220 from going any further. The sensing means may include light or laser sensors, magnetic sensors, electrical contact sensors, etc.

The relationship between the current the Motor 150 draws from the Motor Power Supply Unit 130 and the speed and torque of the motor may be used to determine whether there is a need to stop the motor, or change the direction of rotation. For example, if the current drawn by the Motor 150 when starting from a standing position, either 'up' or 'down', is unique in magnitude and transient time behavior (e.g., the magnitude or transient behavior during a stall condition), this behavior can be used to permit the motor to continue in its initial direction, or change direction and continue until the Seat 260 reaches its final condition, either up or down, as evidenced by the detection of the Stall condition. The startup current, if the Motor 150 is being driven in the 'up' direction, with the Seat 260 down, will be larger than for other conditions or initial seat positions, and thus will be distinguishable in either magnitude or transient time behavior from a true Stall condition. If the current drawn by the Motor 150, when reaching a Stall condition is unique in magnitude and transient time behavior, its analysis can be used to cause the Motor 150 to either reverse or stop. The time interval between a last PIR activation and the event itself may be used to determine whether stopping or reversing the Motor 150 is the proper course of action. Further, a time delay may be used to delay examination of the motor current to prevent the startup current from falsely triggering the Stall Condition.

Since the apparatus is typically installed within a bathroom, where the availability of water makes the presence of high voltage AC power contraindicated, the Battery 120 (e.g., a 9 v) can be recharged from a portable battery supply (e.g., 12 v), which itself has been kept on recharge. Many such batteries for multiple such apparatuses can be recharged from a single portable battery supply. The Battery 120 may be charged through the Recharge Port 240. For example, the Battery Indicator 130 may blink a color (e.g., red) using a light (e.g., an LED) to indicate the need for recharge.

Figure 3:
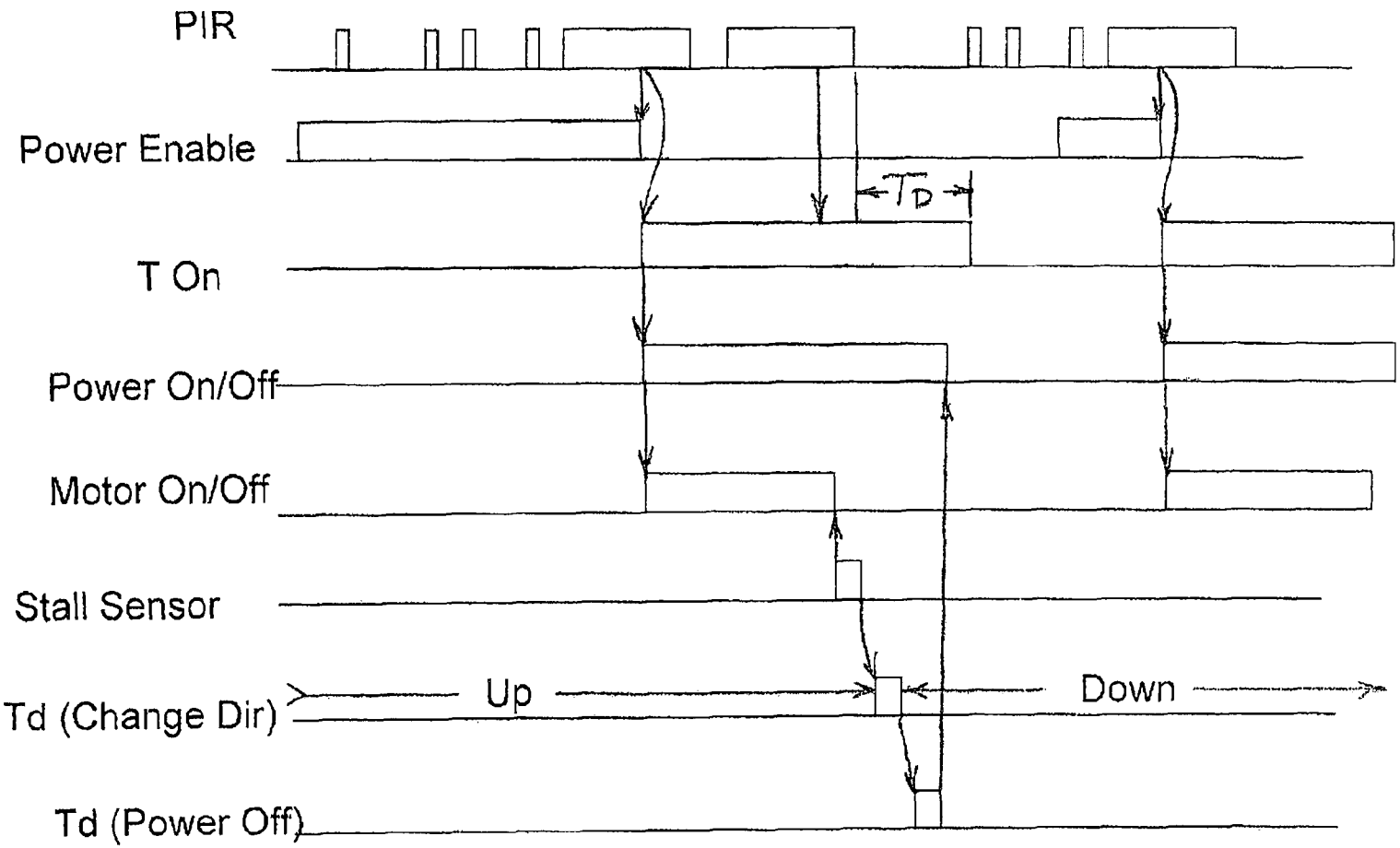
FIG. 3 illustrates timing of signals of the apparatus of FIG. 1, according to an exemplary embodiment of the present invention.

FIG. 3 illustrates timing of signals of the apparatus of FIG. 1, according to an exemplary embodiment of the present invention. During certain conditions, the PIR 100 may emit a pulse PIR that is too short to meet the criteria for registration. The criteria may be a pre-selected time duration $T_{MIN}$ that is chosen to avoid false detection in the environment of installation. When the length of the emitted pulse PIR reaches the pre-selected time duration $T_{MIN}$, the PIR 100 triggers a signal $T_{ON}$, which remains 'on' (e.g., transitions from a logic low to a logic high) for a time period that is longer than time duration $T_{MIN}$. If signal $T_{ON}$ is already 'on' and an acceptable new pulse PIR is recognized, the remaining 'on' time of signal $T_{ON}$ can be extended by the pre-selected time $T_{MIN}$. This renewal can occur as many times as such a pulse PIR is received while signal $T_{ON}$ is on.

The leading edge of signal $T_{ON}$ may be differentiated and used to turn on the Motor Supply Unit 130 to generate a power control signal PowerOn. The power control signal PowerOn is then used to turn on the Motor 150, which outputs a signal MotorON. The motor power may be latched to the 'on' state, and can then be turned off when one of a Stall event or an End event occurs first. The Stall event is the detection of the Stall condition by the Stall Sensor Module 146, which generates a stall signal StallSensor. The end event may be the negative edge of signal Ton, when signal Ton signal transitions from a logic high to a logic low. The length of signal $T_{ON}$ may be configured to be long enough to ensure that the first event occurs first. The stall event starts a signal $T_D$(X Dir) and reverses the control of motor direction sometime during the length of the stall signal StallSensor. This reversal opposes the Stall Sensor condition.

The Stall Event starts a time delay signal $T_D$(PowerOff), which is longer than signal $T_D$(X Dir) to assure that the motor direction control (direction controller 140) has completed is change of direction. At the end of signal $T_D$(PowerOff), a latch of the Motor Power Supply 130 is released, and the Motor 150 stops, leaving the Seat 260 in its last position. If the End Event occurs first (e.g., signal $T_{ON}$ ends before the Stall Event occurs), the negative differentiated edge of signal $T_{ON}$ can be used to unlatch the Motor Power Supply 130, thereby stopping the Motor 150.

Figure 4:
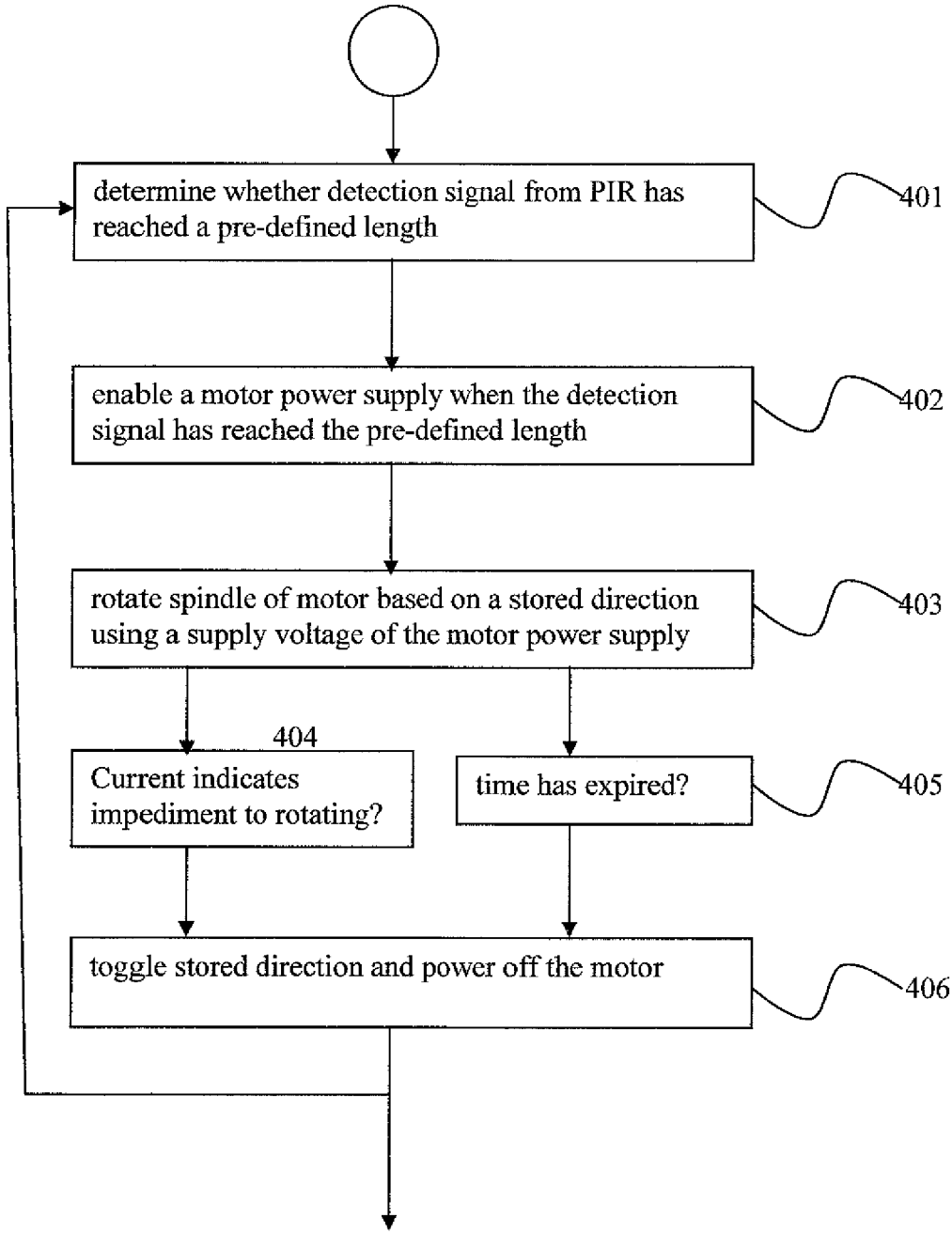
FIG. 4 illustrates a high level flow chart of a method of driving the apparatus of FIG. 1, according to an exemplary embodiment of the present invention.

FIG. 4 illustrates a high level flow chart of a method of driving the apparatus of FIG. 1, according to an exemplary embodiment of the present invention. Referring to FIG. 4, the method includes determining whether a detection signal emitted from a passive infrared sensor (PIR) has reached a pre-defined duration (S401), enabling a motor power supply when the detection signal has reached the pre-defined duration (S402), rotating a shaft of a motor in a direction (e.g., clockwise or counterclockwise) based on a stored direction using a supply voltage of the motor power supply (S403), determining whether current of the motor indicates an impediment to the rotating (S404) and/or determining whether a time period has expired (S405), and then based on either of these events, toggling the stored direction and powering off the motor (S406). Since the Lever 230 is attached to the shaft of the motor (or to a shaft attached to a gear train attached to the shaft) and positioned under the Toilet Seat 260, when the rotating has completed, the Seat 260 has either traveled up or down. The Seat 260 can then be moved in an opposite direction by repeating the above described method.

In an alternate embodiment of the present invention, a second PIR is included in the apparatus. The first PIR (e.g., PIR 100) and the second PIR (not shown) are used together to determine whether a user desires for the Seat 260 to move up or down. The 2 PIRs may be positioned to determine whether a hand has made a rightward motion or a leftward motion. For example, the first PIR could be positioned to the left of the second PIR, and triggering the first PIR with motion followed by triggering the second PIR within a certain time period may trigger the apparatus to move the Seat 260 downward. For example, the Detection Controller Unit 110 may be modified to receive outputs of both PIRs and determine whether the outputs suggest that an upward or downward motion of the Seat 260 is desired. Vice versa, triggering the second PIR with motion followed by the first PIR could trigger the apparatus to move the Seat 260 upwards. The 2 PIRs may alternately be positioned above and below one another, and then detection of motion from up to down could trigger the apparatus to move the Seat 260 downwards and detection of motion from down to up could trigger the apparatus to move the Seat 260 upwards. When two PIRs are used as described, the Direction Control Module 142 and the Direction Memory Module 144 may be omitted. For example, sensing of the stall current need not be used to determine the direction that the shaft is rotated. The Detection Controller Unit 110 can then be modified to apply the voltage Vm to the Motor coil of the Motor 150 to spin the shaft of the Motor 150 in the clockwise rotation direction, or by reversing the side of the coil receiving Vm, to spin the shaft in the counter-clockwise direction based on both outputs of the 2 PIRs.

Since a device according at least one embodiment of the above described invention is mounted to the toilet using the mounting bolts of the existing seat assembly having a standard separation distance, the device is considered a universally installable device. The device can be readily installed on the large population of already installed toilets, without physical alteration of either the seat assembly or the toilet itself. The device may be offered to OEM accounts to be provided as an add-on option to their current toilet seat designs without requiring modification of their standard production.

Figure 5:
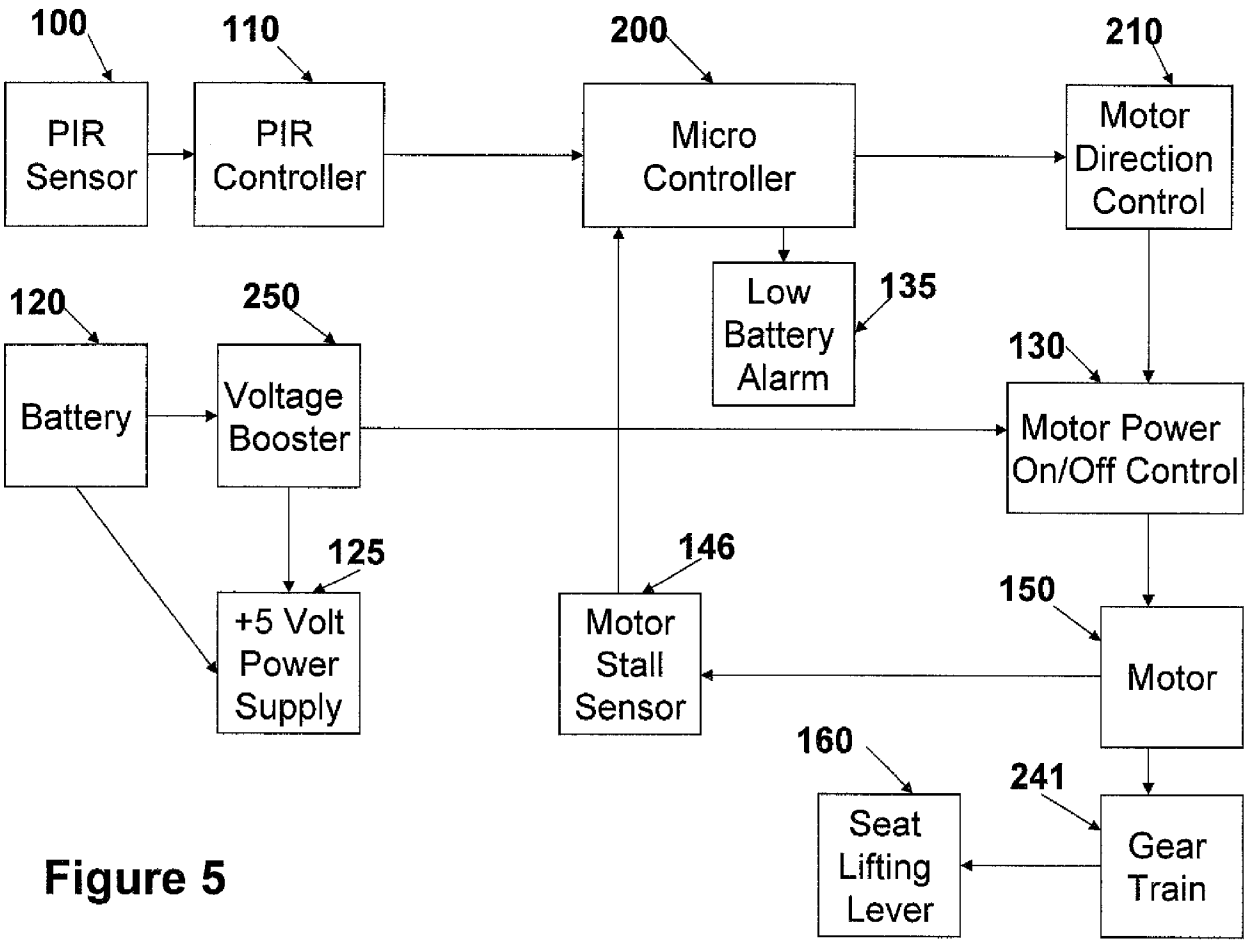
FIG. 5 illustrates a high-level block diagram of an apparatus to lift and lower a toilet seat in a hands free manner, according to another exemplary embodiment of the present invention.

FIG. 5 illustrates a high-level block diagram of an apparatus to lift and lower a toilet seat in a hands free manner, according to another exemplary embodiment of the present invention. Similar to the block diagram of FIG. 1, the PIR Sensor 100 is monitored by the Detection Controller Unit 110, and when a satisfactory signal is observed, (e.g., 200 msec of continuous Infrared sensing), it instructs a Micro-Controller (Micro) 200 to lift or lower the Seat 260, depending on its memory of the last position of the Seat 260. The Micro 200 carries out this instruction using a Motor Direction Control relay 210. The Micro 200 then instructs the Motor Power Supply 130 to turn 'On', and the Motor 150 starts to turn in the proper direction as required.

The Stall Sensor Module 146 monitors current of the Motor 150, and when the current increases to a value deemed by past experience to represent a Stall Condition, (e.g., when the Seat 260 has encountered an obstruction caused by reaching either the top or the bottom of its travel) the Module 146 sends a signal to the Micro 200 to indicate the condition is present, so that the Micro 200 can shut down power to the Motor 150, thus ending the operation. For example, the signal may indicate the current value of the motor current. Stopping the Seat 260 in mid travel by use of a hand will also cause the Micro 200 to end motor power, thus preventing the gears of the Motor 150 from stripping.

Different from the block diagram of FIG. 1, the Motor 150 drives the lifting mechanism 160 through a Gear Train 241. The Gear Train 241 is normally engaged. But, if it is desired to replace the need for a clutch between the Lever 230 and the Motor 150, to protect against application of an external force on the toilet seat, which would damage the Motor 150, a disengagement mechanism may be used to disengage the Gear Train 240 between the Lever 230 and the Motor 150. When the Micro 200 wants the Motor 150 to start, it energizes a Solenoid 235, which engages the gears so that the Motor 150 can drive the lifting mechanism 160. When the Motor 150 is told to stop, the Micro 200 de-energizes the Solenoid 235, disengaging the gears. This allows the Seat 260 to be lifted or lowered manually (e.g., by a hand), if desired, so long as the PIR Sensor 100 is not activated. This eliminates the need for a clutch, which was discussed above with respect to FIG. 1 to prevent stripping of the gears if someone inadvertently lifted the seat by hand.

In an exemplary embodiment of the present invention, the battery 120 has a 6 volt output when fully charged. Over time and use of the apparatus, the battery 120 will gradually lose its charge. For example, the charge could eventually fall to 3.2 volts. The apparatus may optionally include a Voltage Booster 250, which can maintain a constant voltage (e.g., about 12 v to about 16 volt) to the Motor 150, regardless of the voltage of the Battery 120. The output of the Voltage Booster 250 is fed to the DC supply 125 (e.g., +5 volt) supply, which is used to operate the rest of the elements of the apparatus, even when the voltage of the Battery 120 falls below a threshold level (e.g., about 3.2 volts). Since all voltages are monitored by the Micro 200, the Micro 200 is able to control the operation of the Voltage Booster 250 to maintain all needed voltages in their required range, until the Battery 120 is essentially completely drained. Before the battery 120 dies, the Micro 200 can use the Battery Condition Indicator 135 to send out a signal to alert a user to change the Battery 120. In this way, a supply voltage (e.g., about 5 volts) to the computer chips may be maintained, even if the booster voltage drops to the threshold level (e.g., about 3.2 volts).

Figure 6:
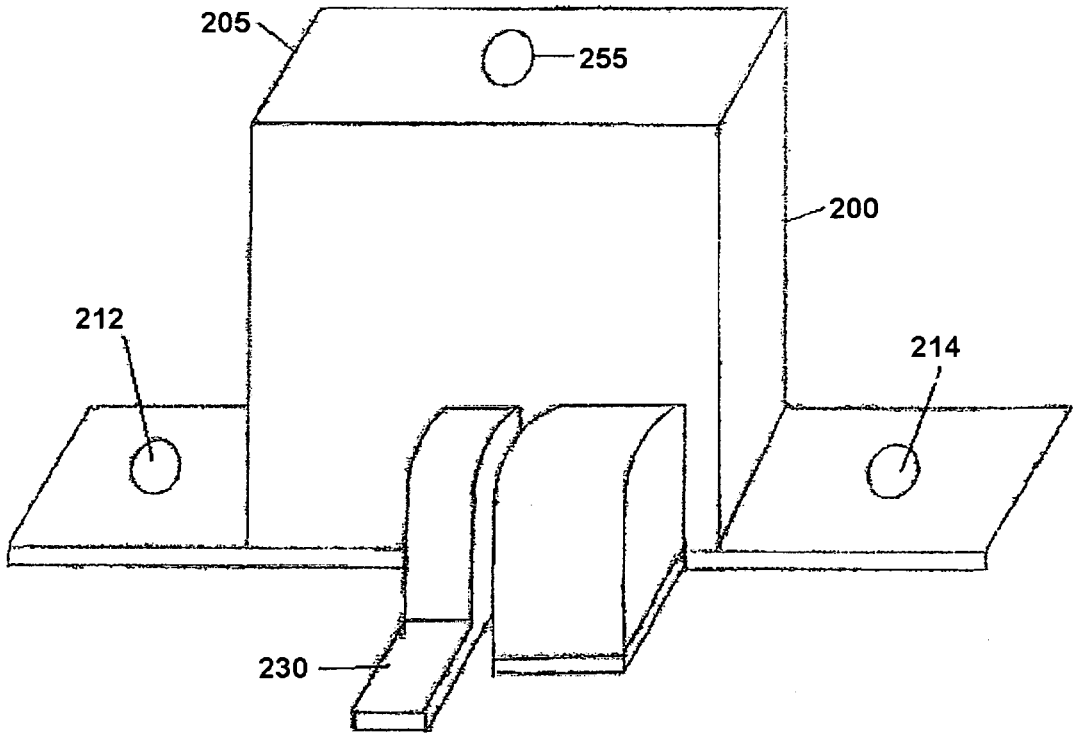
FIG. 6 illustrates an assembly view of the apparatus of FIG. 5, according to another exemplary embodiment of the present invention.

FIG. 6 illustrates an assembly view of the apparatus of FIG. 5, according to another exemplary embodiment of the present invention. In this embodiment, the lever 230 is positioned in front of the case, and is driven by the Gear Train 241 connecting the Motor 150 to a shaft of the Lever 230.

Figure 7:
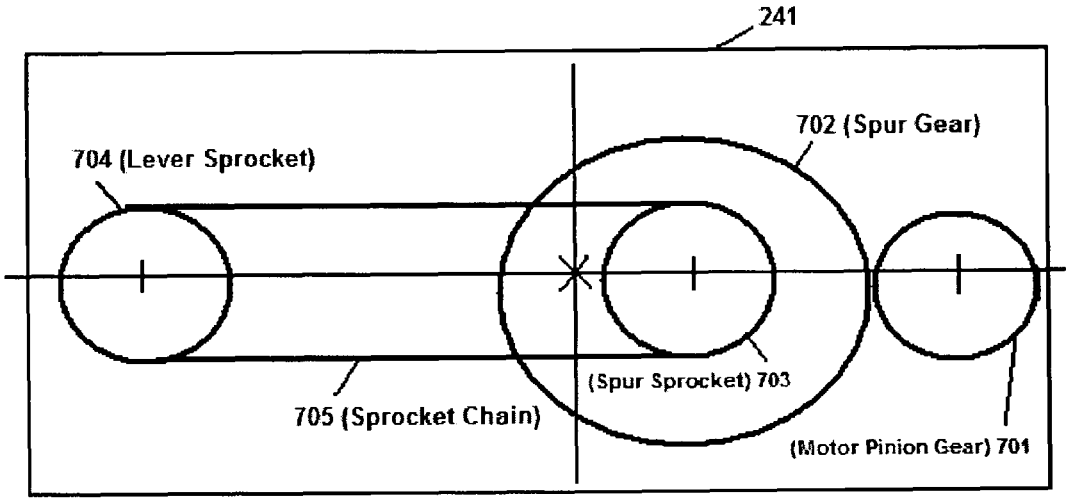
FIG. 7 illustrates a gear train of FIG. 6, according to an exemplary embodiment of the present invention.

FIG. 7 illustrates elements of a gear train 241 of FIG. 5 being attached to a Motor 150, according to an exemplary embodiment of the present invention. Referring to FIG. 7, a pinion gear 701 is attached to the shaft of the Motor 150. The shaft may be supported by a first rod (not shown) in the case. When a second gear (e.g., a spur gear) 702 is engaged into the pinion gear 701, the second gear 702 turns in the opposite direction as the pinion gear 701. In an exemplary embodiment of the present invention, the second gear 702 has a diameter that is about 3 times larger than the pinion gear 701. A first axle (not shown) may be fitted through the center of the second gear 702, which enables the gear to rotate. The first axle may be supported by a second rod (not shown) in the case. The first axle drives (rotates) a pair of sprockets 703 and 704 having a corresponding chain 705. The sprockets 703 and 704 drive (rotates) a shaft attached to the Lever 230. The arrangement shown in FIG. 7 may lift the Lever 230 at the same speed as the apparatus of FIG. 1, but with more torque, as a larger motor may be utilized.

According to an exemplary embodiment of the present invention, the pinion gear 701 may be pulled apart (e.g., disengaged) from the second gear 702 using a spring (not shown) and pushed together (e.g., engaged) using a solenoid (not shown). Since this pushing and pulling requires an axle of the first or second gear 701 or 702 to be able to move laterally, one of the corresponding supporting rods may include a slot that allows an axle of one of the gears 701 or 702 to be moved from side to side. The width of the slot is configured to be wide enough to allow the gears 701 and 702 to be separated from one another.

Figure 8:
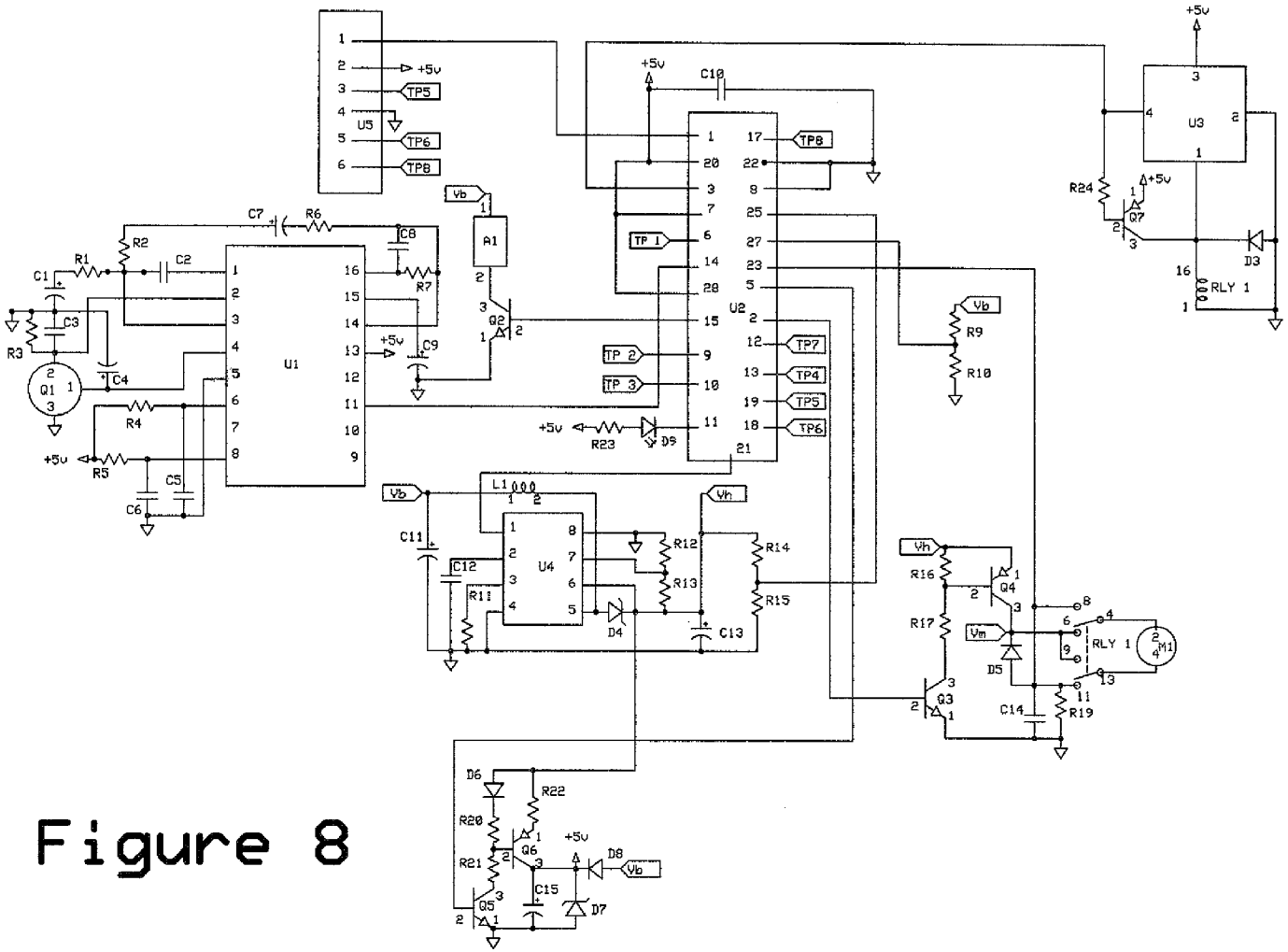
FIG. 8 illustrates a detailed schematic of the apparatus of FIG. 5, according to an exemplary embodiment of the present invention.

FIG. 8 illustrates a detailed schematic of the apparatus of FIG. 5, according to an exemplary embodiment of the present invention. Referring to FIG. 8, the PIR Sensor Q1 and the PIR Controller U1 operate in a similar manner to those previously described, except that the positive output gate of PIR Controller 11 is delivered directly to Micro Controller 13. The Micro Controller U2 is a programmable computer chip, which may be equipped with I/O, RAM, ROM, A/D Converters.

The Micro Controller U2 is programmed to react to the positive gate to perform the functions described below. For example, the Micro Controller U2 recalls the memorized direction that the Motor M1 (e.g., Motor 150 of FIG. 5) should rotate, which will be opposite to the last time the motor was turned on. The rotation is executed by the Micro Controller U2 either turning on or off a Power Switch U3 or Q7, which determines the state of the contacts of the Double Pole Double Throw relay X1 (or a solid state equivalent). Power On causes the Motor M1 to rotate in the Lift direction, and Power Off causes a Lowering direction of rotation, when Motor voltage Vm is applied.

After turning the Power Switch U3 On or Off, the Micro Controller U2, causes transistor Q3 to turn transistor Q4 On. This delivers voltage Vm to Relay RLY 1. Depending on the energized or de-energized condition of the relay coil, the positive voltage Vm, will be applied to one or the other side of the Motor M1, corresponding to the Clockwise or Counter Clockwise rotation of the corresponding shaft.

Current of the Motor M1, whether rotating in either direction, is delivered to Ground via resistor R19. The voltage across R19 is therefore directly proportional to the current of the Motor M1. This current is a function of motor speed and torque. So, when the Motor M1 is stalled due to an obstruction, the current increases to a limit which may be termed the Stall Current. The Resistor R19 is bypassed by Capacitor C13 to insure that transients will not falsely cause a voltage spike that could be interpreted as a breaching of the Stall Current.

The voltage across Resistor R19 is delivered to the Micro Controller U2, which uses its A/D conversion function to create a digital number proportional to the current of the Motor M1. The Micro Controller U2 compares this number to an internally stored digital number N1, representing an amount of Motor current above which it can be declared that the Motor M1 is about to Stall. This Stall condition should not be permitted as it might damage the gears of the Motor M1. But, in any event, the condition means that the Seat 260 has reached the end of its travel and is being restricted from further lifting or lowering by a physical obstruction. For example the obstruction could be either the Toilet itself, if going Down, or the Water Tank, or other obstruction, if going Up. So, on breaching this predetermined Stall threshold, the Micro Controller U2 shuts off transistor Q4, terminating the On state of transistor Q3 and terminating the rotation of the shaft.

In an exemplary embodiment of the present invention, the battery 120 is a 6 volt battery and supplies power to each element of the apparatus. This may avoid the need to create a separate power supply to operate the individual elements, which may operate in one embodiment between 4.5 and 5.5 volts, and up to a 7 volts maximum. Thus all elements of the apparatus can be operated directly from the Battery 120 via a Diode D5, which can be used to reduce the voltage from 6 volts to 5.4 volts. When the battery 120 is 6 volts, it may comprise four 1.5 volt cells (e.g., AA, C, etc).

In an exemplary embodiment of the present invention, the Motor M1 (or 150) is provided as a 12 volt device. In an exemplary embodiment where the Motor 150 is 12 volts and the battery is 6 volts, 12 volts is created from the 6 volts to operate the Motor 150. This may be accomplished by embodying the Voltage Booster 250 as a Voltage Doubler. Alternatively a Voltage Booster 250 can be used, which not only produces an output voltage greater than 6 volts, but maintains this high voltage essentially independent of the gradually declining battery voltage, as its capacity is used up.

The Voltage Booster 250 may be represented by element U4, whose output voltage $V_H$ can be, in one embodiment, as high as 16 volts. Use of element U4 may be used to keep the Motor power essentially constant, up to the point where the battery 120 is essentially fully drained. When the battery 120 is 6 volts and four 1.5 volt batteries are used, this point may be reached when each 1.5 volt battery cell is reduced to 0.8 volts.

However, before all the power in the battery 120 is used up, the original 6 volt total would have long since been reduced to 3.2 volts, well below the operating level of some or all of the elements of the apparatus. Accordingly, in an exemplary embodiment of the present invention, the Micro Controller U2, having access to the chip supply voltage (see V+ in FIG. 8, e.g., about +5 v), and observing its level falling below a threshold level periodically turns on the Voltage Doubler or Booster 250, even when not called upon to run the Motor 150. For example, if the Micro 200 determines that the battery voltage has fallen below a threshold voltage (e.g., to 4.8 volts or below), the Micro can control transistor Q5 to recharge C15 up to a higher level (e.g., 5.5 volts) to restore the charge on C15 to a previous level (e.g., to at least 4.5 volts), so long as voltage Vb is high enough to keep voltage $V_H$ above a desired voltage (e.g., about 10 volts), below which the system will be shutdown anyway by the Micro This process can repeat as often as necessary to maintain the voltage levels between an operable range (e.g., between about 4.5 volts and about 5.5 volts). This may insure continued operation of the PIR Controller 100 and the other elements, even when the voltage of the battery 120 falls to a low level (e.g., 3.2 volts).

In an exemplary embodiment of the present invention, an alarm is used to alert a user that the battery 120 needs to be replaced. The Micro Controller U2 can be configured to sense depletion of voltage of the battery 120 to some still viable level (e.g., 3.3 volts) and then enable transistor Q2 to activate a Piezoelectric Buzzer A1, whose audio can be heard outside the case of the apparatus.

The alarm can be used for other purposes, such as when the Micro Controller U2 (or 200) senses a condition that might affect performance. An example would be the development of very high friction in the lifting mechanism itself, which would cause an increase in the average Motor current required. This can be done by storing/memorizing the value of the Motor current when first installed, and comparing the most recent values after much usage has occurred.

As discussed above, the value N1 represents an amount of Motor current above which it can be inferred that the Motor M1 is about to stall. This value N1 can be derived by actual experience in each installation, in which the toilet Seat weight or friction can vary from a norm, and in which Battery depletion, if not remedied by the function described above, can be a factor in determining Stall current behavior. Accordingly, in an exemplary embodiment of the present invention, the Micro Controller U2 is configured to examine the actual measured Stall Current and derive a dynamic Stall Current Reference from the observed behavior.

Further, as discussed above, when Motor power is first turned on, the Motor M1 may require more current initially (e.g., a startup current) before reaching steady state operation. If the startup current too large, it may trigger the Stall Detection routine and stop Motor M1 rotation effectively before it even starts. Accordingly, in an exemplary embodiment of the present invention, the behavior of the Motor current is analyzed by the Micro Controller U2 to determine how long it takes for the Motor current to decline from the high Startup value to a normal Steady State value. The Micro Controller U2 then activates a Stall Sensor Time Delay, which for that amount of time after startup, may be used to prevent a false Stall Current value from prematurely shutting down operation of the Motor M1.

Referring back to FIGS. 5 and 6, the Motor 150 may be mounted parallel to the axis of the Seat 260 to the side of a case from which the shaft or rod exits (e.g., by two machine screws). A Battery Mount may be secured to the interior of the case above the Motor 150 by either screws, stand-offs or by welding. Access to the Battery mount may be gained by an opening on the side opposite to the Coupler 220, which may be covered by a gasket and a cover Plate, which are attached (e.g., bolted) to the Battery Mount, which simultaneously secures the Batteries into the Mount, while permitting sufficient force holding the Plate against the exterior side of the Case 200 to compress the gasket. This may insure that the entire assembly is sealed against entry of water. The exit point of the shaft or rod may be "O" ring sealed.

The top cover 205 of the case 200 is sealed (e.g., it may be welded). The top cover 205 may have a hole which provides an opening which is sealed by installation of a Fresnel Lens that focuses Infrared Radiation on the PIR Sensor. The Lens may be covered by a Plastic Infrared Filter Window 255, which also serves to seal the top cover 205 against the entry of water. The Motor 150 may be installed from an opening in the Base 210, which may be covered by a Plate and/or a cemented gasket. This gasket may be further held in place by the Seat Bolts, which force the entire assembly against the Toilet Bowl, again reinforcing the Seal against entry of water.

In a further embodiment, as shown in FIG. 6, the entire cover 205 is held down against the base by suitable means. For example, when the cover is held down in this way, all components of the apparatus (e.g., motor, battery, computer circuit board, etc.) can be installed directly on the base without a bottom access hole. The cover can then be removed by lifting it vertically to expose the battery for replacement. In this example, it is not necessary to provide a gasketed plate as no opening for the battery is now required.

In the embodiment shown in FIG. 7, the gear train 241 connecting the Motor 150 to the Lever 230 consists of a Motor pinion 701, a Spur gear 702 driven by the pinion, a Sprocket 703 on the hub of the Spur gear 702, a chain 705 connecting that Sprocket to a second Sprocket 704, located on the Shaft that drives the Lever 230. In such a design, the lifting rotation rate and available lifting torque on the Lever 230 are constant, and independent of the angle of the Lever 230 or the height of the toilet seat 260 above its initial position.

Figure 9:
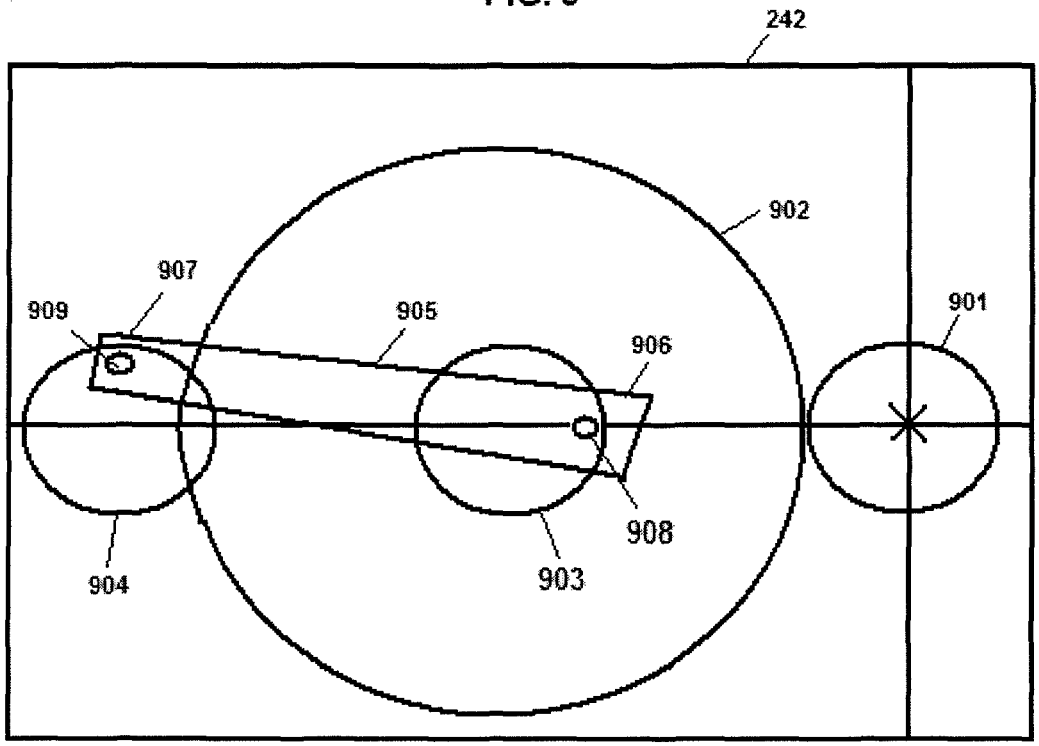
FIG. 9 illustrates a gear train of FIG. 6, according to an exemplary embodiment of the present invention.

However, torque needed to lift the toilet seat is not constant with its angle, but approximately co-sinusoidal, starting with a maximum force when the seat is horizontal, or down, and decreasing to Zero when the seat is vertical. For that reason, a means of providing such a transition of force is desirable. This objective can be obtained by the means described below, in conjunction with FIG. 9. Referring to FIG. 9, a gear train 242 includes a Pinion 901, a Spur gear 902, a Hub 903 (part of the Spur gear 902), and a Hub 904, whose central axis drives the Lever shaft and Lever 230.

Instead of sprockets and chains connecting the two Hubs as in FIG. 7, there is a Connecting Rod 905, which has shaft extensions 906 and 907, each of which enters a bearing 908 or 909 on the respective Hubs 903 and 904, and is capable of rotating within these bearings as the Hubs 903 and 904 rotate.

Note that the relative position of the bearings are such as that when the toilet seat 260 is down, the bearing 908 on the Spur gear Hub 903, is on the horizontal axis, while the bearing 909 on the Lever Shaft Hub 904, is on the vertical axis. Thus, when the driving Hub 903, is rotated counterclockwise by the Motor 150, the driven Hub 904, is in a position to apply maximum torque to its shaft, and the rotational speed will be low, due to the primary act of the Hub 903 is in the lifting phase, not the lowering phase. As the Motor 150 turns the Spur gear 902 counterclockwise at constant rotational velocity, and as the Seat 260 is lifted, Hub 904 transitions to positions of lower torque, consistent with the declining force need to lift the seat as it becomes more vertical, but of higher velocity. But, it eventually reaches a point where the two hubs 903 and 904 complete a 90 degree rotation, with the seat 260 now lifted to the vertical position, and where the stall sensor 146 will stop the motor 150, terminating the lifting phase.

Accordingly, this configuration delivers its highest torque when it is needed to start lifting the seat from its initial horizontal position, and then increases the lifting velocity to complete the lifting cycle in a shorter time.

Figure 10:
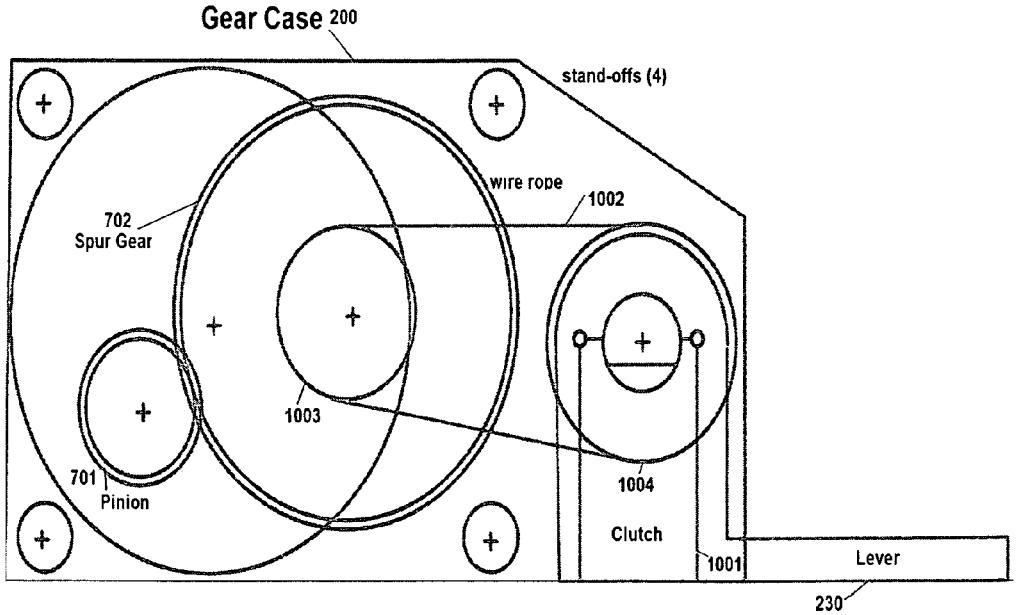
FIG. 10 illustrates a gear train of FIG. 6, according to an exemplary embodiment of the present invention.

FIG. 10 illustrates a gear train of FIG. 6, according to an exemplary embodiment of the present invention. Similar to FIG. 7, the gear train includes a motor pinion gear 701 interfaced with a spur gear 702. A hub 1004 of a shaft coupled to the lever 230 by a clutch 1001 is attached to a hub 1003 of the spur gear 702 by a wire rope 1002. The wire rope 1002 may be secured to the hub 1003 by wrapping a loop of the wire rope 1002 around the hub 1003 and pinning the loop to the hub 1003 using a screw. The wire rope 1002 may be secured to the other hub 1004 in a similar manner. The wire rope 1002 enables the lever 230 to move in a range of about ninety degrees. For example, rotation of pinion gear 701, rotates the spur gear 702, which in turn rotates the wire rope 1002, which in turn rotates the hub 1004 of the shaft, thereby lifting or lowering the lever 230.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the disclosure.

What is claimed is:

1. An apparatus configured to lift and lower a seat assembly of a toilet, the apparatus comprising:

a base including a first slot and a second slot spaced apart from one another to correspond to a distance between mounting holes of the toilet to receive existing mounting bolts of the seat assembly; and a case having a front wall a pair of opposing side walls substantially perpendicular to the front wall, and a bottom wall substantially perpendicular to the front and side walls, wherein the case comprises:

a passive infrared sensor (PIR) that outputs a detection signal in response to motion;

a lever;

a coupler;

a motor, wherein the lever is coupled to a shaft of the motor via the coupler;

a direction control unit that applies a motor supply voltage to drive the shaft in one of a clockwise or counterclockwise direction in response to the detection signal; and a battery to provide power to the apparatus wherein the base is adjacent the bottom wall of the case and positioned such that the first slot is disposed to the left of one of the side walls and the second slot is disposed to the right of the opposing side wall.

2. The apparatus of claim 1, wherein the direction control unit applies the motor supply voltage to drive the shaft of the motor in one of the clockwise or counterclockwise direction based on a stored direction state.

3. The apparatus of claim 2, wherein the direction control unit is configured to toggle the stored direction state each time the PIR sensor is activated.

4. The apparatus of claim 2, wherein the apparatus is configured to trigger a power down of the motor when a stall condition is sensed.

5. The apparatus of claim 4, further comprises a stall sensor to set the stall condition when the stall sensor determines that current of the motor has exceeded a threshold level.

6. The apparatus of claim 5, further comprising:

a motor power supply unit that provides the motor supply voltage to the direction control unit when enabled; and a detection controller that selectively enables or disables the motor supply unit when the stall condition is set.

7. The apparatus of claim 6, wherein the detection controller is configured to wait a predetermined time interval before re-enabling the motor supply unit.

8. The apparatus of claim 6, wherein the apparatus is configured to disable power to the motor, the direction control unit, and the motor power supply unit after the direction control unit completes rotation of the shaft.

9. The apparatus of claim 4, wherein the stall sensor sets the stall condition after a predefined period has elapsed and the stall sensor determines that current of the motor has exceeded a threshold level.

10. The apparatus of claim 1, wherein the apparatus is configured to power down the motor after a predefined period of time has elapsed after the detection signal has been initiated.

11. The apparatus of claim 1, wherein the case includes a switch and a direct current (DC) power supply providing power from the battery to the apparatus, and the switch is configured to disengage the DC power supply from the battery during a sleep period and re-engage the DC power supply with the battery during a different waking period.

12. The apparatus of claim 1 further comprising:

a battery level indicator; and a battery monitoring unit to monitor the power level of the battery and set the indicator based on the level.

13. The apparatus of claim 1, wherein the lever is configured to freely slide against the underside of the toilet seat, and a position at which the lever exits the case and the length of the slots are configured to enable the apparatus to be positioned to permit the rotation axis of the lever to conform closely with the axis of rotation of the seat assembly.

14. The apparatus of claim 1, wherein the base includes front and back opposing edges, and the slots extend from the front edge towards the back edge such that the length of the slots is a majority of a distance between the edges.

15. The apparatus of claim 1, wherein a top wall of the case opposing the bottom wall includes an opening that is sealed by a Frensel Lens that focuses infrared light on the PIR.

16. An apparatus configured to lift and lower a toilet seat, the apparatus comprising:

a case that is configured to be mounted to a toilet using mounting bolts of a seat assembly of the toilet, wherein the case comprises:

a first passive infrared sensor (PIR) that outputs a first detection signal in response to motion;

a second PIR that outputs a second detection signal in response to motion;

a lever;

a coupler;

a motor; wherein the lever is coupled to a shaft of the motor via the coupler; and a direction control unit that applies a motor supply voltage to drive the shaft of the motor in one of a clockwise or counterclockwise direction in response to both of the detection signals, wherein the direction control unit triggers the shaft to rotate in one of the clockwise or counterclockwise direction upon detecting that the first and second detection signals have occurred in succession within a first period and triggers the shaft to rotate in the other direction upon determining that the second and first detection signals have occurred in succession within a second period different from the first period.

17. The apparatus of claim 16, wherein the case includes a first extension with a first slot and a second extension with a second slot, wherein the slots spaced to correspond to space between mounting holes of the toilet that receive the mounting bolts, wherein the case includes a front wall, a pair of opposing side walls substantially perpendicular to the front wall, and a bottom wall substantially perpendicular to the front and side walls, and wherein the first extension is located to the left of one of the side walls and the second extension is located to the right of the opposing side wall.

* * * * *